US005538135A

United States Patent [19]

Hexter, Jr.

[11] Patent Number: 5,538,135

[45] Date of Patent: *Jul. 23, 1996

[54] DUAL-MEDIUM ARTICLES, INCLUDING HINGED ARTICLES

[75] Inventor: Peter K. Hexter, Jr., Wilmington, N.C.

[73] Assignee: Cui, Inc., Wilmington, N.C.

[ * ] Notice: The term of this patent shall not extend beyond the expiration date of Pat. No. 5,363,964.

[21] Appl. No.: 304,526

[22] Filed: Sep. 12, 1994

Related U.S. Application Data

[63] Continuation-in-part of Ser. No. 121,267, Sep. 14, 1993, Pat. No. 5,363,964.

[51] Int. Cl.[6] ..... B65D 85/48; G09F 1/12; B42D 9/00; A47G 1/06

[52] U.S. Cl. ..... 206/449; 40/120; 40/779; 40/790; 116/234; 206/459.5; 229/92.8; 281/42; 428/14

[58] Field of Search ..... 116/234; 281/42; 283/117; 206/449, 459.5; 40/154, 156, 120; 428/14; 229/92.8

[56] References Cited

U.S. PATENT DOCUMENTS

| | | | |
|---|---|---|---|
| 746,847 | 12/1903 | Klopsch | 116/234 |
| 782,199 | 2/1905 | Keplinger . | |
| 1,117,085 | 11/1914 | Potts . | |
| 1,924,429 | 8/1933 | Winzeler . | |
| 2,113,871 | 4/1938 | Bozung . | |
| 2,282,939 | 5/1942 | Clawson | 116/234 X |
| 2,873,877 | 2/1959 | Morin | 206/45.34 X |
| 2,964,010 | 12/1960 | Harrison | 281/42 X |
| 2,979,224 | 4/1961 | Henchert . | |
| 3,516,597 | 6/1970 | Bigelow . | |
| 4,125,655 | 11/1978 | Kanzelberger . | |
| 4,291,798 | 9/1981 | Transport . | |
| 4,309,835 | 1/1982 | Naeve . | |
| 4,515,838 | 5/1985 | Miyajima . | |
| 4,624,875 | 11/1986 | Watanabe et al. . | |
| 4,767,647 | 8/1988 | Bree . | |
| 4,779,752 | 10/1988 | Vallee et al. . | |
| 5,010,673 | 4/1991 | Connor et al. . | |
| 5,215,792 | 6/1993 | Miller . | |
| 5,363,964 | 11/1994 | Hexter, Jr. | 206/449 |

FOREIGN PATENT DOCUMENTS

| | | | |
|---|---|---|---|
| 755122 | 11/1933 | France . | |
| 0251492 | 10/1990 | Japan | 116/234 |
| 3-244596 | 10/1991 | Japan | 116/234 |
| 102959 | 1/1924 | Switzerland . | |
| 453194 | 11/1936 | United Kingdom . | |

*Primary Examiner*—Bryon P. Gehman
*Attorney, Agent, or Firm*—Carter & Schnedler

[57] ABSTRACT

Various dual-medium articles which advantageously combine two mediums, metal for appearance and durability, and cardboard which affords high quality printing. The articles include a generally rectangular metal substrate having front and rear sides, and a cardboard insert sheet adjacent the rear side. The metal substrate includes a central main portion, four edge marginal portions terminating in respective substrate edges, and four corner marginal portions. The marginal portions surround the central main portion, sharing respective boundaries therewith, and are rolled towards the substrate rear side and around such that the substrate edges contact the insert sheet so as to hold the insert sheet in position. The rolled marginal portions together define a continuous bead around the periphery of the card without any exposed sharp edges. In some embodiments the rolled edges are replaced by hinge sleeves. Thus, specific embodiments include a greeting card having two elements joined by a hinge, and a gift greeting box with an insert sheet in the cover, with a hinge joining the cover to a receptacle base. Another embodiment takes the form of a stand-up indicia-bearing article such as a calendar, wherein the insert sheet is die cut to form a pop-out easel.

28 Claims, 11 Drawing Sheets

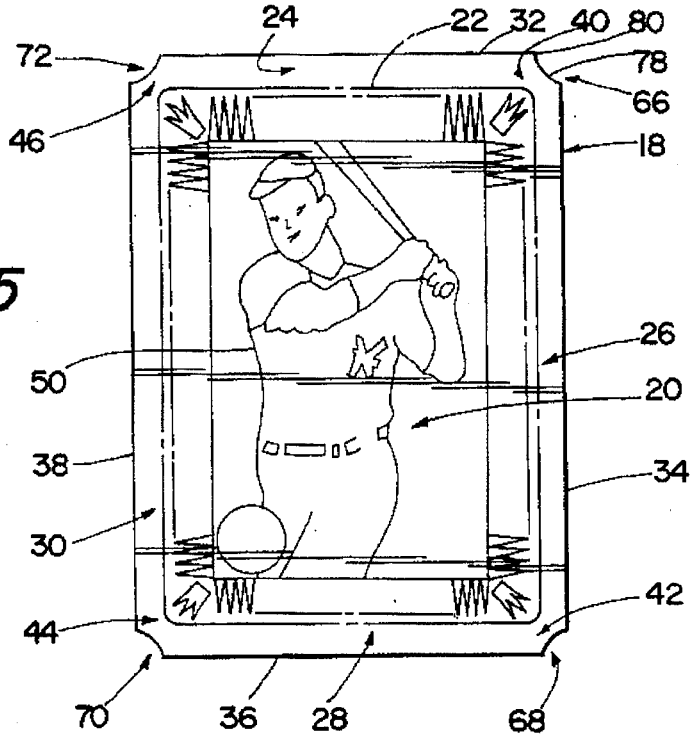
Fig. 5
Fig. 6
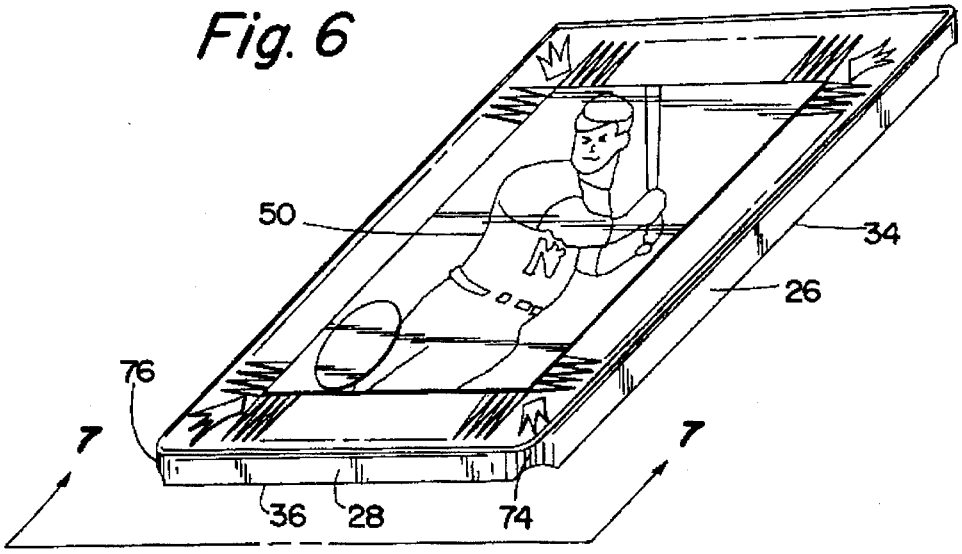
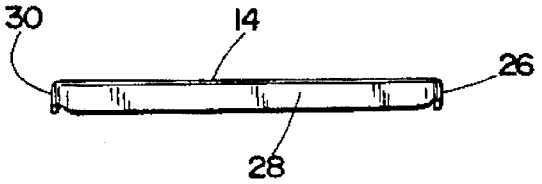
Fig. 7

Fig. 13
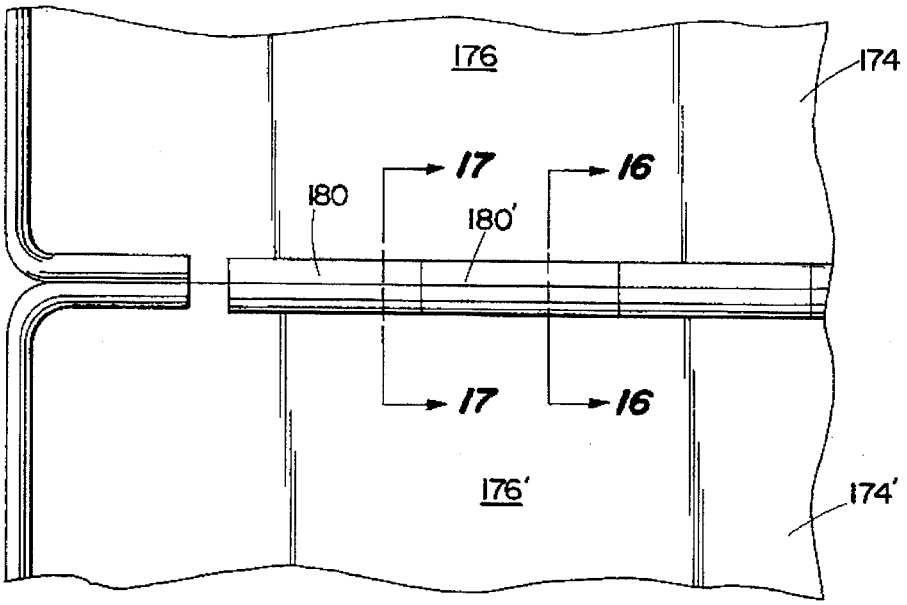
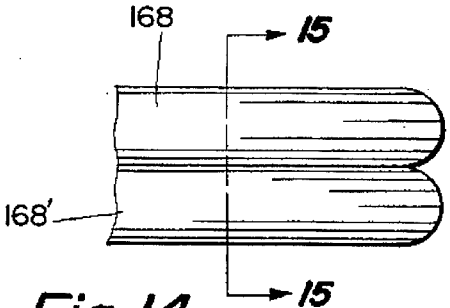
Fig. 14
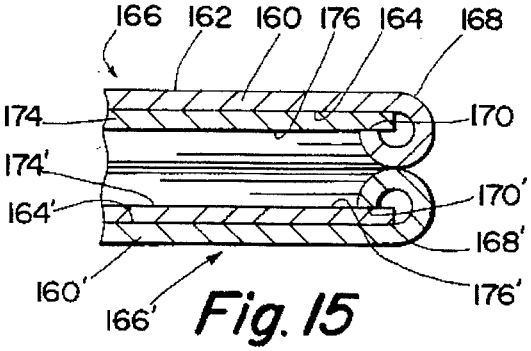
Fig. 15
Fig. 16
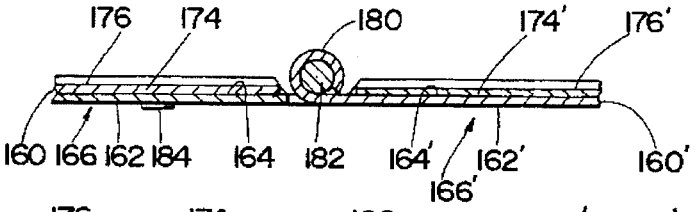
Fig. 17
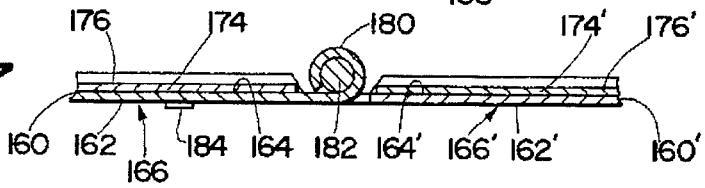
Fig. 18
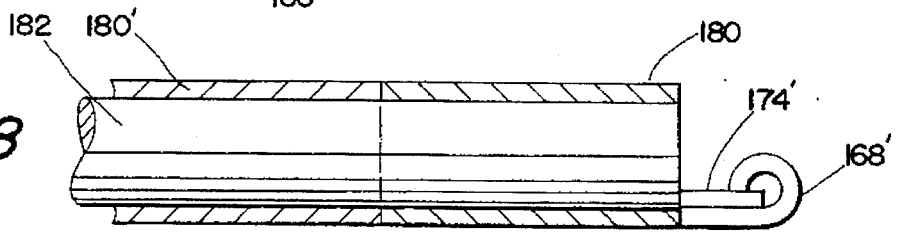

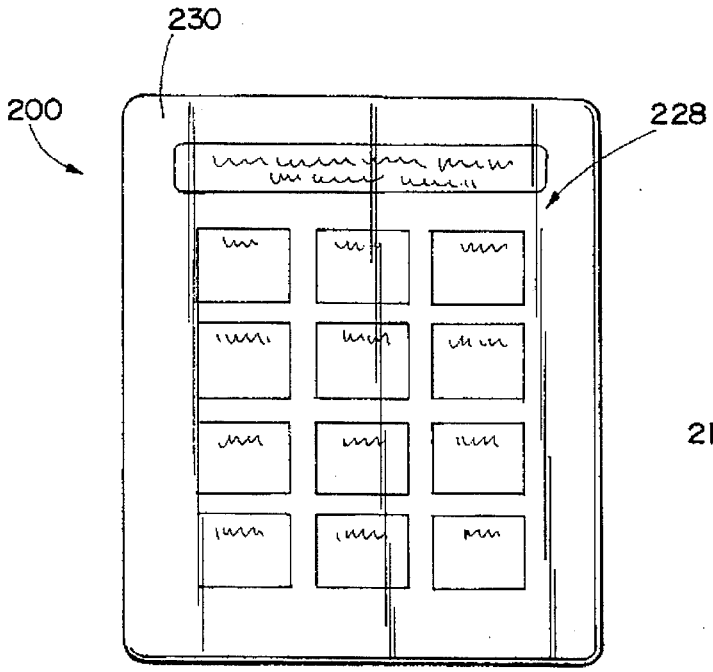
Fig. 19
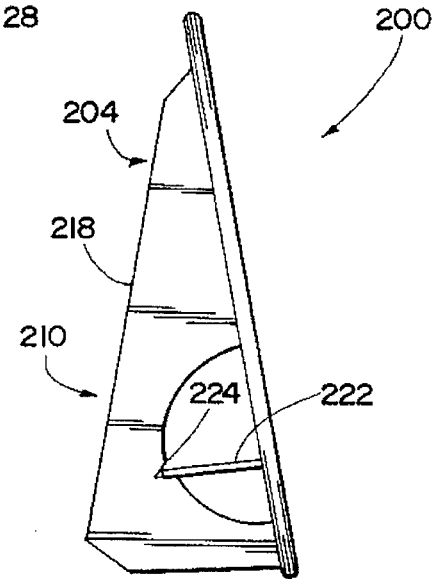
Fig. 20
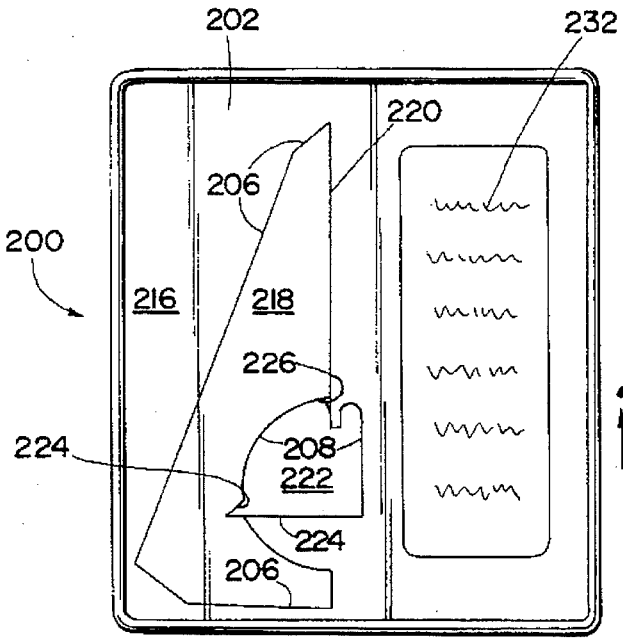
Fig. 21
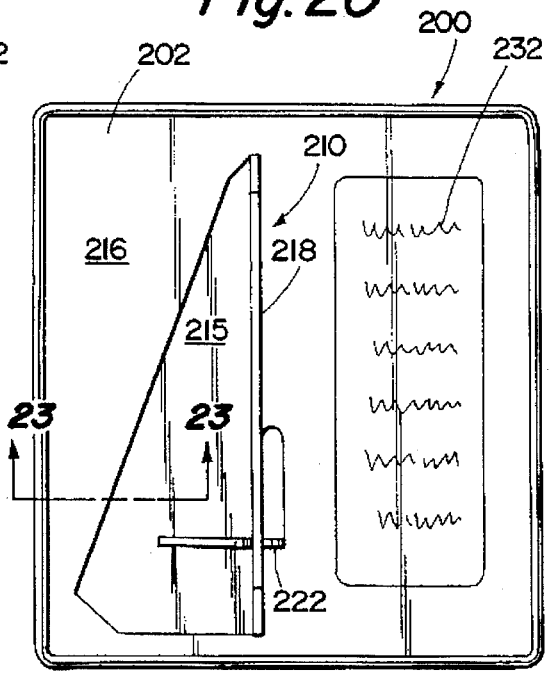
Fig. 22
Fig. 23
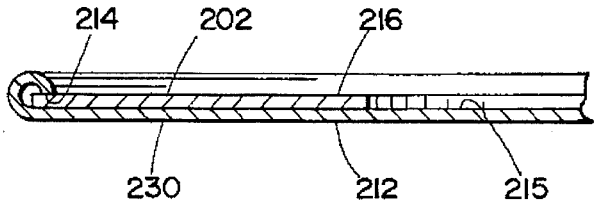

DUAL-MEDIUM ARTICLES, INCLUDING HINGED ARTICLES

CROSS-REFERENCE TO RELATED APPLICATION

This is a continuation-in-part of application Ser. No. 08/121,267, filed Sep. 14, 1993, entitled "Embossed Metal Trading Card and Container Therefor," now U.S. Pat. No. 5,363,964.

BACKGROUND OF THE INVENTION

The invention relates generally to dual-medium articles, which advantageously combine two mediums such as metal and a paper-based sheet material.

One embodiment of the invention more particularly relates to polygonal dual-medium articles, such as collectible trading cards (e.g. baseball trading cards), bookmarks, and similar articles, of various sizes and shapes.

Traditionally, collectible trading cards have been made of thin cardboard, with a photograph on one side, and information printed on the other side.

Recently, for permanency and enhancement of appearance, it has been proposed to make such cards of lithographed sheet metal, for example as is disclosed in Miller U.S. Pat. No. 5,215,792. However, one disadvantage of such metal trading cards is that it is difficult, if not impossible, to achieve on sheet metal the quality of printing which can be achieved on other sheet materials, particularly paper-based sheet materials.

Another disadvantage, recognized in the above-referenced Miller patent, is that a raw piece of sheet metal contains sharp edges and corners which would make such a piece unsafe for use as a trading card. In view of this, Miller proposes a construction wherein the edges are folded to form flat hems presenting radiused surfaces at least on the outer edges of the card, leaving unfolded edges only at the corners, which unfolded edges are short in length.

SUMMARY OF THE INVENTION

Accordingly, it is an object of the invention to provide a dual-medium article of enhanced appearance.

It is another object of the invention to provide a dual-medium article which is free of raw edges and sharp corners and which is thus safe to handle.

It is another object of the invention to advantageously employ the malleable characteristic of metal in a dual-medium article to provide metallic articles with decorative features not readily achievable in conventional thin cardboard trading cards.

It is yet another object of the invention to provide various dual-medium articles which are readily manufacturable.

Briefly, in accordance with the invention there is provided an article which advantageously combines two mediums, metal and a paper-based sheet material. More particularly, the dual-medium article is in the form of a polygonal metal substrate having front and rear sides, a main portion, four edge marginal portions terminating in respective substrate edges and four corner marginal portions. The edge marginal portions and the corner marginal portions surround the main portion and share respective boundaries with the main portion. Substrate indicia is printed on the front side. Preferably, the substrate main portion has embossed areas which serve as design elements.

Adjacent the substrate rear side is an insert sheet, for example made of a paper-based material such as cardboard, and having insert sheet indicia printed on an insert sheet indicia side which faces away from the substrate rear side. While the metal substrate is quite durable, and facilitates unique decorative effects, printing of a much higher quality is possible on paper-based materials compared to sheet metal, and various and attractive glossy effects can be achieved. Thus the invention combines the advantages of both mediums.

To complete the construction, the edge marginal portions and the corner marginal portions of the metal substrate are rolled towards the substrate rear side and around such that the substrate edges contact the indicia side of the insert sheet so as to retain the insert sheet in position. The rolled edge marginal portions and the rolled corner marginal portions together define a continuous bead around the periphery of the card without any exposed sharp edges.

The dual-medium metallic article of the invention preferably is formed from a flat blank wherein the corner marginal portions have concave cutouts to avoid interference when the side marginal portions are rolled. However, each of the corner marginal portions has material remaining between its respective concave cutout and the boundary shared by the corner marginal portion and the main portion, which remaining material facilitates the forming of the continuous and smooth bead even around the corners of the finished article.

In another embodiment of the invention, a foldable article such as a greeting card is provided, comprising a pair of dual-medium elements joined by a hinge, each with a retained insert sheet. In another embodiment, the cover of a container has rolled edges which retain an insert sheet, and the cover is hinged to a receptacle. In yet another embodiment, the retained insert sheet is die-cut to define a fold-out easel, resulting in a stand-up indicia-bearing article such as a calendar.

The invention is applicable to many other products, such as post cards and book covers.

BRIEF DESCRIPTION OF THE DRAWINGS

While the novel features of the invention are set forth with particularity in the appended claims, the invention, both as to organization and content, will be better understood and appreciated, along with other objects and features thereof, from the following detailed description taken in conjunction with the drawings, in which:

FIG. 5 depicts a flat blank representing an initial step in the fabrication process;

FIG. 6 depicts a subsequent step in the fabrication process where edge and corner marginal portions have been bent towards the substrate rear side;

FIG. 7 is an end view on line 7—7 of FIG. 6;

FIG. 13 is an enlarged view of the hinge portion of the greeting card of FIG. 11;

FIG. 14 is a fragmentary side elevational view of the greeting card of FIG. 11 when closed;

FIG. 15 is a fragmentary section taken on line 15—15 of FIG. 14;

FIG. 16 is a section taken on line 16—16 of FIG. 13;

FIG. 17 is a section taken on line 17—17 of FIG. 13;

FIG. 18 is a fragmentary sectional view taken on line 18—18 of FIG. 11, with the hinge pin shown in full;

FIG. 19 is a front elevational view of a metallic stand-up indicia-bearing article in the representative form of a calendar in accordance with another embodiment of the invention;

FIG. 20 is a side elevational view of the calendar of FIG. 19 with the easel in its functioning position;

FIG. 21 is a rear elevational view of the calendar of FIG. 19 with the easel in its folded position;

FIG. 22 is a rear elevational view of the calendar of FIG. 19 with the easel in its functioning position;

FIG. 23 is a section on line 23—23 of FIG. 22;

DETAILED DESCRIPTION

Figure 1:
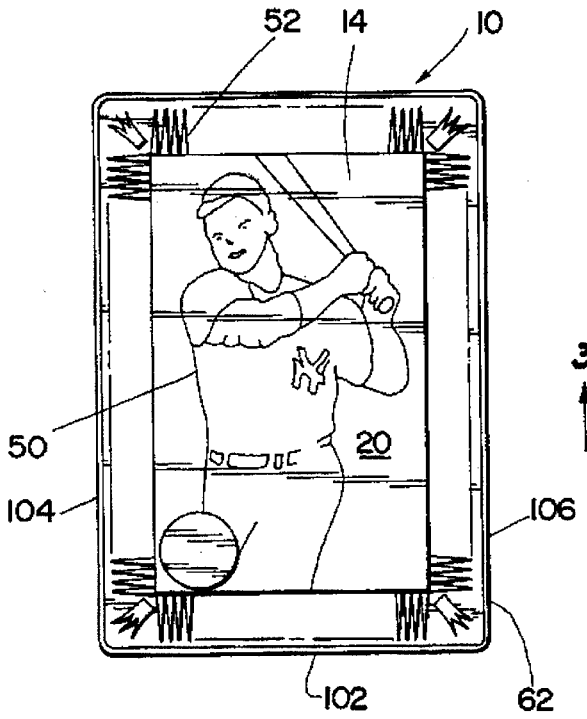
FIG. 1 is a front view of a metallic article in the representative form of a metallic trading card in accordance with the invention.
Figure 2:
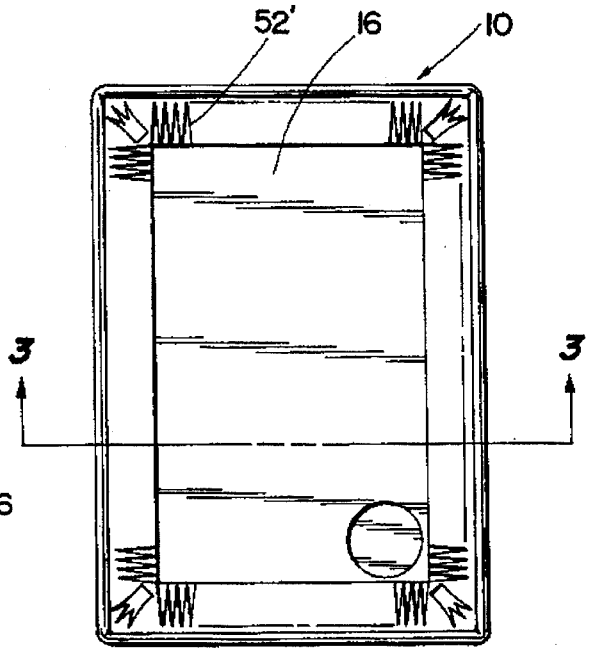
FIG. 2 is a rear view of the metallic card of FIG. 1 but omitting, for purposes of illustration, the cardboard insert sheet.
Figure 3:
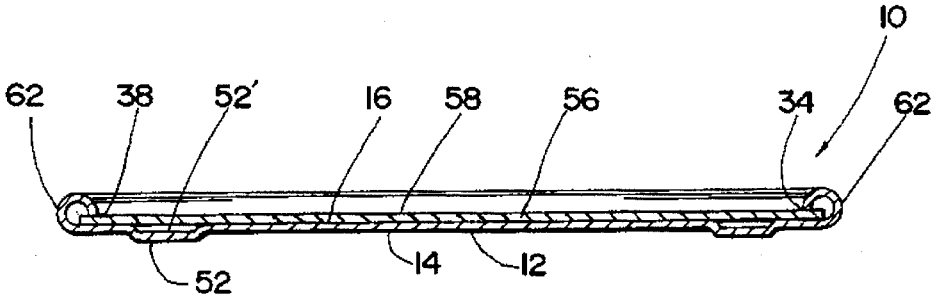
FIG. 3 is a section taken along line 3—3 of FIG. 2, but with the cardboard insert sheet in place.

Referring now to the drawings, FIGS. 1–4 depict a dual-medium article in the representative form of a metallic trading card 10 in accordance with the invention except that, for convenience of illustration, the printed cardboard back insert is omitted from FIG. 2. FIGS. 5–8 depict various intermediate steps in the process of fabricating the card 10 of FIGS. 1–4. Various elements of the card 10 are referred to hereinbelow both with reference to FIGS. 1–4 and with reference to FIGS. 5–8.

The trading card 10 includes a generally rectangular metal substrate 12 having a front side 14 (FIG. 1) and a rear side 16 (FIG. 2). The substrate 12 is formed from a generally rectangular flat sheet metal blank 18, represented in FIG. 5.

The substrate 12 includes a central main portion 20, which comprises most, but not all, of the portion visible in FIG. 1. In FIG. 5, the central main portion 20 is within a phantom boundary line 22. It will be appreciated that the boundary 22 depicted in phantom in FIG. 5 is not actually physically present in the blank 18; rather, the boundary 22 coincides generally with subsequent bends as the card 10 is formed from the blank 18.

As is also best seen in FIG. 5, surrounding the central main portion 20 are four edge marginal portions 24, 26, 28 and 30 terminating in respective substrate edges 32, 34, 36 and 38, and four corner marginal portions 40, 42, 44 and 46, also surrounding the main portion 20. Each of the edge marginal portions 24, 26, 28 and 30 and each of the corner marginal portions 40, 42, 44 and 46 shares a respective boundary with the main portion 20, the respective boundaries comprising segments of the boundary 22 depicted in phantom.

Substrate indicia 50 are provided on the front side 14 of the substrate 12, in the representative form of a baseball player 50. It will be appreciated, however, that the substrate indicia 50 is not so limited, and may comprise a player of any sport, any person who is to be featured on a collectible trading card, any image in general, or even mere information presented as writing.

For decorative purposes, the main portion 20 includes design elements in the form of raised or embossed areas 52. FIG. 2 depicts the same embossed areas from the rear side, which are in the form of corresponding depressions 52'. Advantageously, the card 10 may be included in a set of cards having different indicia 50, but wherein the embossed areas 52 comprise design elements common to all the cards of the set. Printed design elements may or may not coincide with the embossed areas 52, depending upon the particular design of the card 10.

Adjacent the substrate rear side 16 is an insert sheet 56 having an indicia side 58 facing away from the substrate 12 rear side 16, with insert sheet indicia such as textual material 60 on the insert sheet 56 indicia side 58. The insert sheet 56 is preferably made of a paper-based material such as thin cardboard, and has a durable finish. Thus, and as noted hereinabove, the construction of the invention combines two mediums and the advantages of each. The metal substrate provides durability and facilitates unique decorative effects, and the insert sheet 56 of paper-based material affords improved quality of printing, particularly of the textual material 60.

To retain the insert sheet 56 in position, and also to form a smooth continuous bead 62 around the entire periphery of the card 10 without any exposed sharp edges, the edge marginal portions 24, 26, 28, 30 and the corner marginal portions 40, 42, 44 and 46 are rolled towards the substrate 12 rear side 16 and then around, such that the substrate edges 32, 34, 36 and 38 contact the indicia side 58 of the insert sheet 56. To avoid interference when the side marginal portions 24, 26, 28 and 30 are rolled, the blank 18 (FIG. 5) has concave cutouts 66, 68, 70 and 72 at the corners thereof.

It is significant that each of the corner marginal portions 40, 42, 44 and 46 has material remaining between the respective concave cutout 66, 68, 70 or 72 and that portion of the boundary 22 shared by the particular corner marginal portion 40, 42, 44 or 46 and the main portion 20. This is particularly evident in the partially formed view of FIGS. 6 and 7, where material remains on the side of the partially-formed piece as indicated at 74 and 76. In the finished card 10, the result is manifested as may be seen in the enlarged corner view of FIG. 4, as well as in the cross section of FIG. 4A wherein a corresponding portion 62' of the rolled edge or bead 62 runs entirely around the depicted upper corner of the card. A terminating point 78 of the cutout 66 of FIGS. 5 and 6 becomes in the finished card 10 of FIGS. 4 and 4A, the point 78. The side edge 80 of the cutout 66 of FIG. 5 becomes in the finished card 10 the side edge 80 visible in FIG. 4 and in full in FIG. 4A.

Although aspects of the manufacturing process have been mentioned hereinabove, the manufacturing process for the card 10 will now be described in greater detail with reference to FIGS. 5–8.

Typically, the manufacturing process begins with a large "tin" sheet (e.g. thirty six inches by twenty nine and one-half inches) being printed in a four color process, employing an automatic printing press which feeds into a drying oven. Typically, images for approximately sixty to eighty trading cards 10 are printed on each of the large sheets. A suitable material is known as steel sheet, and is approximately 0.009 inch in thickness. The finished cards 10 are approximately 2½ by 3½ inches in size, with a bead 62 thickness of, for example, 3/32 inch.

The approximately sixty to eighty images or substrates are then individually cut from the large printed sheets, and are transferred to presses which cut the substrates to exact size, as represented in FIG. 5. Typically, a first punch or press having appropriate tooling is employed to cut away any excess tin sheet to form a rectangle, and then a second punch or press having appropriate tooling is employed to remove material to define the concave cutouts 66, 68, 70 and 72.

Subsequently, a third punch or press is employed to bend the edge marginal portions 24, 26, 28 and 30 and the corner marginal portions 66, 68, 70 and 72 towards the substrate rear side 16, resulting in the configuration of FIG. 6. The forming operation of this third press deforms the metal in a manner related to that of a drawing operation, wherein a degree of metal stretching occurs in a transformation from a flat configuration to a three-dimensional configuration. Again, appropriate tooling is employed.

In addition, either prior to or immediately after the forming operation of the third press, a press with suitable embossing dies is employed to form the embossed areas 52 in the main portion 20. As noted hereinabove, the embossed areas 52 may or may not correspond to printed design elements, depending upon the design of the particular card 10 or set of cards 10.

Figure 8:
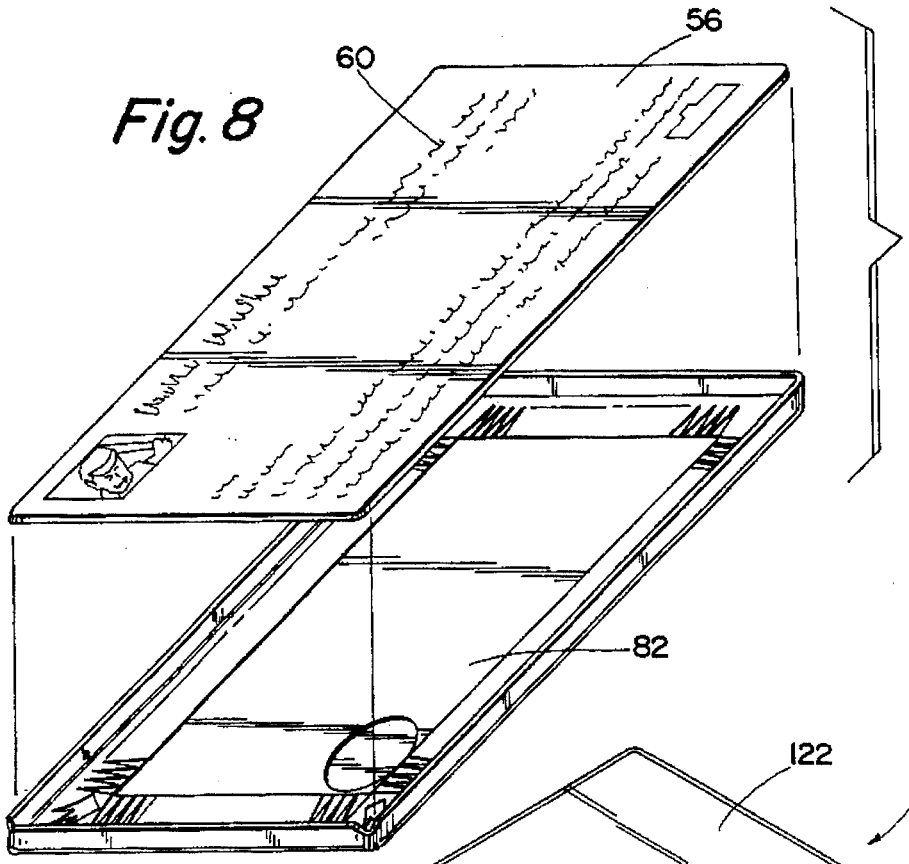
FIG. 8 depicts another subsequent step in the fabrication process wherein the rear side insert sheet is being positioned, prior to completing the rolling of the marginal portions.

Next, as is represented in FIG. 8, the partially formed card of FIG. 6 is turned over, and the insert sheet 56 is placed in the recess 82 resulting from the bending of the side marginal portions 24, 26, 28 and 30 and the edge marginal portions 40, 42, 44 and 46 towards the rear side 16. The insert sheet 56 is previously prepared, employing high quality materials, preferably paper-based, and a high quality printing process.

Figure 4A:
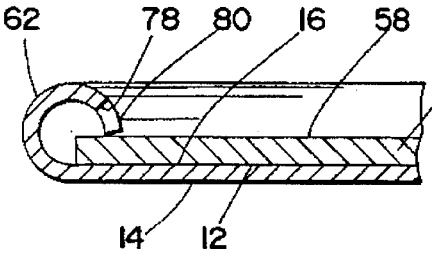
FIG. 4A is a further enlarged section taken on line 4A—4A of FIG. 4 showing corner details.
Figure 4:
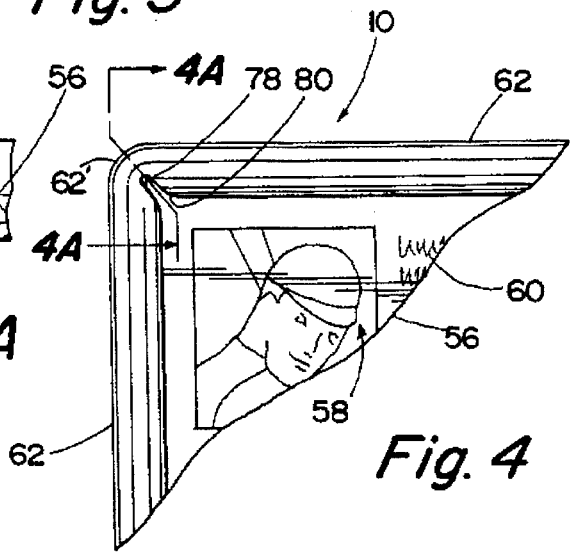
FIG. 4 is an enlarged detail generally of the upper left corner of FIG. 2, but with the cardboard insert sheet in place, and indicia on the insert sheet.

Finally, the marginal portions are rolled so as to form the bead 62 and retain the cardboard insert sheet 56 in position. During this final metal forming operation, particular care is taken, employing suitable tooling, so as to provide round corners without exposed sharp edges, the result of which is illustrated in FIGS. 4 and 4A described hereinabove.

Figure 9:
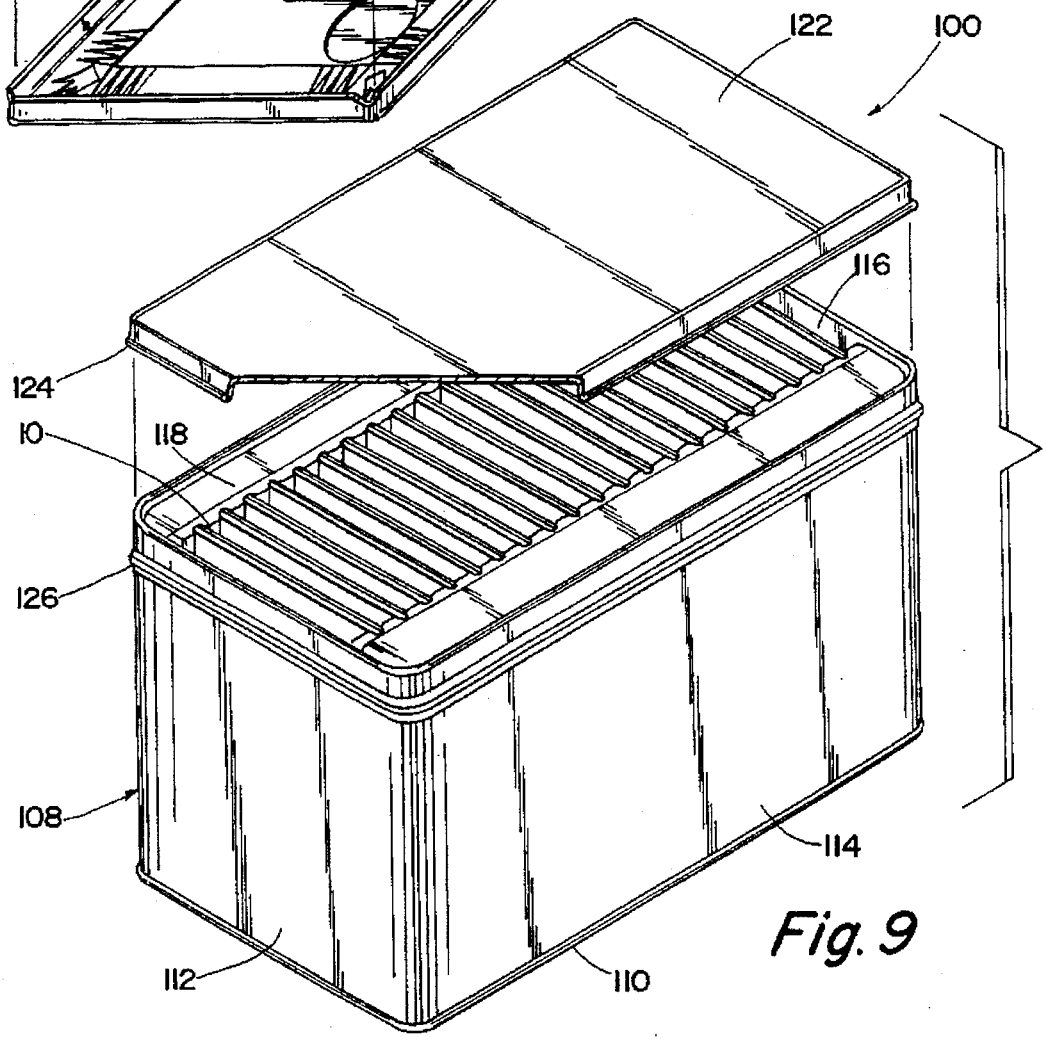
FIG. 9 depicts a boxed set of metallic trading cards.
Figure 10:
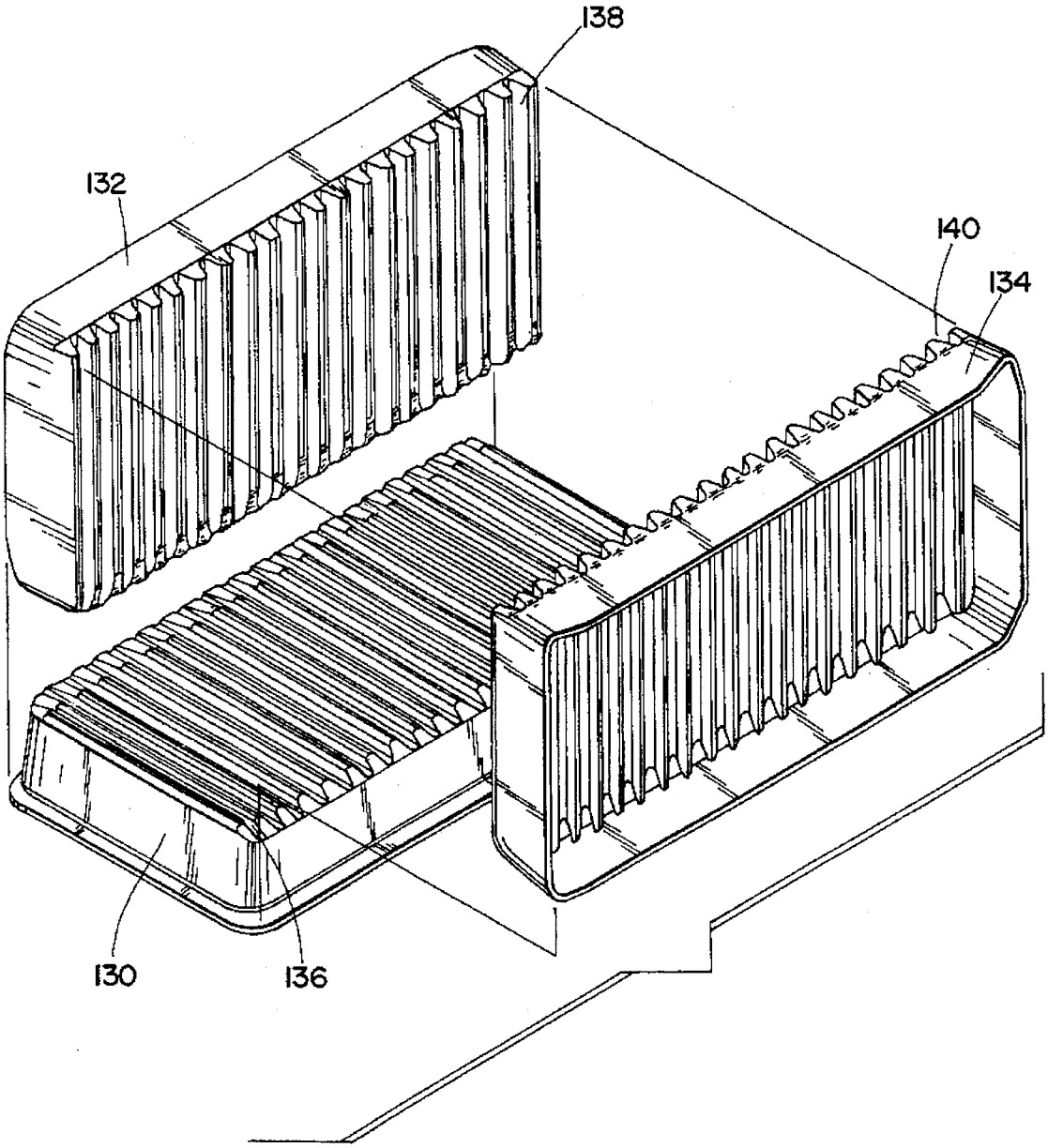
FIG. 10 is an exploded view of card support members included within the storage tin of FIG. 9.

Referring next to FIGS. 9 and 10, FIG. 9 depicts a boxed set 100 comprising a plurality of metallic trading cards 10, each orientable (with reference to FIG. 1) so as to have a lower edge 102 and two side edges 104 and 106. The cards 10 are contained within a storage tin 108, which is in the form of a generally rectangular receptacle having a bottom 110 and four upright sides 112, 114, 116 and 118. A press fit cover or lid 122 is provided, having a rolled edge 124, and a bead 126 is formed on the sides 112, 114, 116 and 118 of the receptacle, corresponding to the closed position of the lid 122. Although not illustrated in FIG. 9, preferably the storage tin 108 and cover 122 are provided with decorative designs, printing and embossing.

Within the tin 108, and best seen in the exploded perspective view of FIG. 10, are a lower card support member 130, and a pair of side card support members 132 and 134. The card support members 130, 132 and 134 have corresponding channels 136, 138 and 140 for respectively receiving the lower edges 102 and the side edges 104 and 106 of the cards 10. Illustratively, the card support members 130, 132 and 134 comprise vacuum-formed or molded plastic elements. However, it will be appreciated that the card support elements 130, 132 and 134 may take a variety of forms.

FIGS. 11–18 depict another embodiment of the invention, which is a foldable dual-medium article in the representative form of a greeting card 150. The greeting card 150 includes a pair of nearly identical rectangular elements 152 and 154 which are joined by a hinge, generally designated 156, and which generally comprise the front and back of the greeting card 150. Although the elements 152 and 154 are shown as rectangles, it will be appreciated that various other polygonal shapes may be employed.

It will be appreciated that the greeting card 150 is similar in appearance to conventional card stock folded greeting cards, with the exception that the front and back elements 152 and 154 each are constructed in a manner similar to the metallic trading card 10 of FIGS. 1–10. Two mediums are thus combined, namely metal and a paper-based sheet material for example, with rolled edges of the metal retaining the paper-based sheet material in position. In addition, to form the hinge 156, the rolled edges are modified so as to form interdigitated sleeve elements which are part of the hinge 156. The resultant article is attractive and durable, and combines the advantages of the two mediums employed.

More particularly, the polygonal elements 152 and 154 comprising the front and back of the card 150 comprise polygonal metal substrates 160 and 160' having outer sides 162 and 162', inner sides 164 and 164' main portions 166 and 166' pluralities of edge marginal portions 168 and 168' terminating in respective substrate edges 170 and 170', and pluralities of corner marginal portions 172 and 172' all generally in the same manner as is described hereinabove in detail with reference to the metal trading card 10 of FIGS. 1–10.

Adjacent the inner sides 164 and 164' are insert sheets 174 and 174' the insert sheets 174 and 174' having respective indicia sides 176 and 176' facing away from the inner sides 164 and 164'. The insert sheets 174 and 174' are retained by rolled substrate edges 170 and 170', likewise in the same manner as the card 10.

At least a portion of one of the edge marginal portions 178 and 178' of the elements 152 and 154 comprises an element of the hinge 156. More particularly, sleeve elements 180 and 180' for the hinge 156 are formed in at least a portion of the edge marginal portions 178 and 178'.

Figure 12:
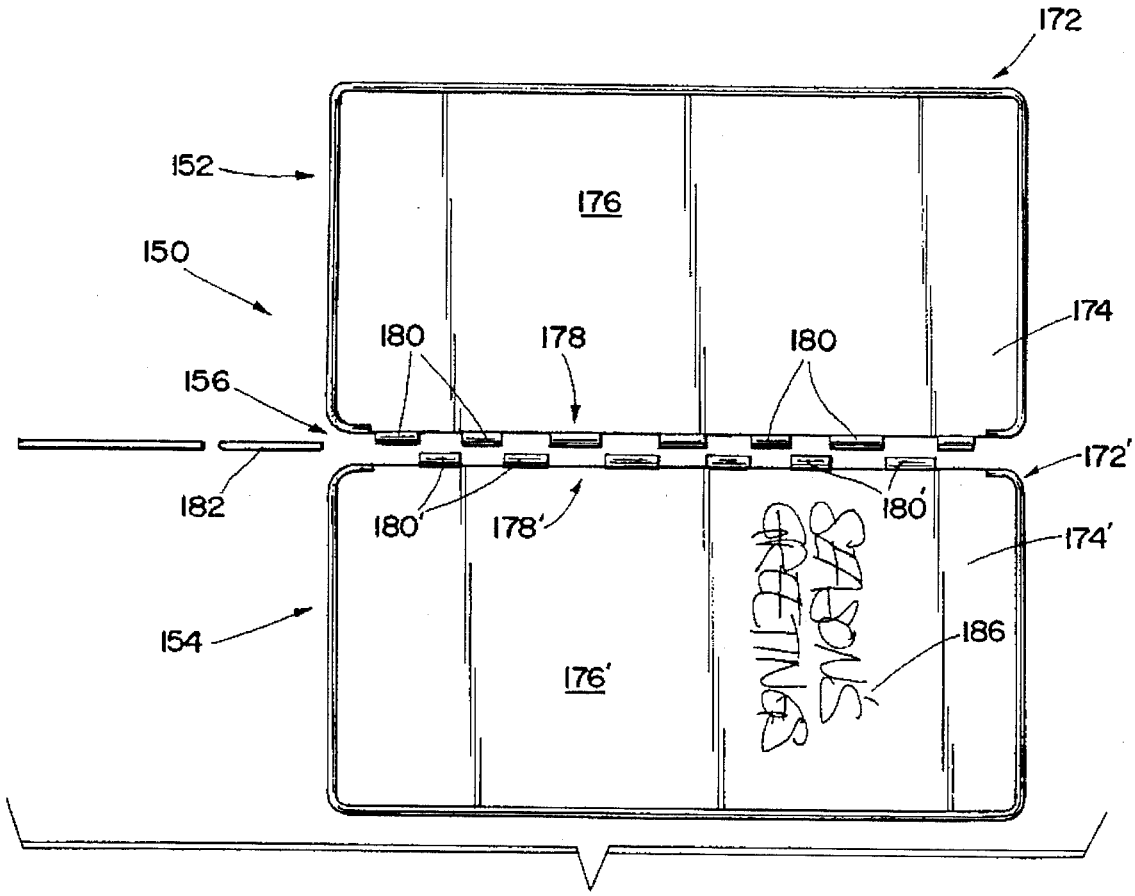
FIG. 12 is an exploded view of the greeting card of FIG. 11.

As is perhaps best seen in FIG. 12, the sleeve elements 180 of one of the article elements 152 are interdigitated and aligned with sleeve elements 180' of the other of the article elements 154, and a hinge pin 182 is positioned within the aligned sleeve elements 180 and 180'. The interdigitation is further represented in FIGS. 16, 17 and 18.

Since the constructional details of the elements 152 and 154 are generally as described hereinabove with reference to the metal trading card 10 of FIGS. 1–10, further details thereof are not repeated here.

Indicia 184 (FIGS. 16 and 17) is printed on the outer side 162 or 162' of at least one of the metal substrates 160 or 160' as is appropriate for the example of a greeting card. At least one of the insert sheets 174 and 174', in this example the insert sheet 174' has indicia 186 on the indicia side 176' thereof.

With reference now to FIGS. 19–23, another embodiment of the invention is a dual-medium stand-up indicia-bearing article in the representative form of a calendar 200, which is similar to the trading card 10 of FIGS. 1–10, with the exception of the overall size, which is larger, and a card stock insert sheet 202 of suitable weight on the rear side 204 thereof having cut lines 206 and 208 defining elements of a fold-out easel 210. Like the trading card 10, the article 200 has a metal substrate 212 with rolled edges 214 which retain the insert sheet 202 in position against the substrate rear side 215, the rolled edges 214 contacting the visible side 216 of the insert sheet 202.

More particularly, the easel 210 has a main portion 218 which folds out from a vertical fold line 220, and a locking portion 222 which folds outwardly and downwardly from a horizontal fold line 224. The easel main portion 218 and the locking portion 222 have respective notches 224 and 226 which engage in a conventional manner when the article 200 is in the in-use functional configuration of FIGS. 20 and 22.

While the article of FIGS. 19–23 can take any desired form, and is not necessarily rectangular in configuration, a calendar 200 is illustrated, including calendar indicia 228 on the front side 230 of the metal substrate 212, and other indicia 232, such as an event schedule, printed on the visible side 216 of the insert sheet 202.

When the easel 210 is folded out to the in-use functional position of FIGS. 20 and 22, a portion of the rear side 215 of the metal substrate 212 is visible. Preferably, the rear side 215 is printed or painted the same color as the card stock insert sheet 202, and, in addition, may have printing or other indicia thereon cooperating with printing or indicia on the insert sheet 202 itself.

Figure 24:
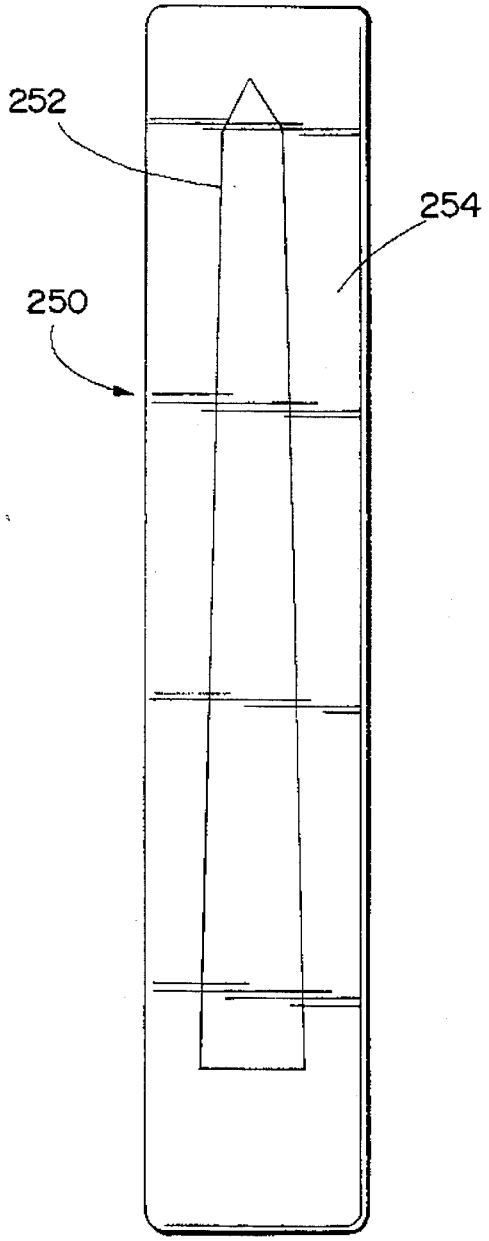
FIG. 24 is a front view of a metallic article in the representative form of a bookmark in accordance with another embodiment of the invention.
Figure 25:
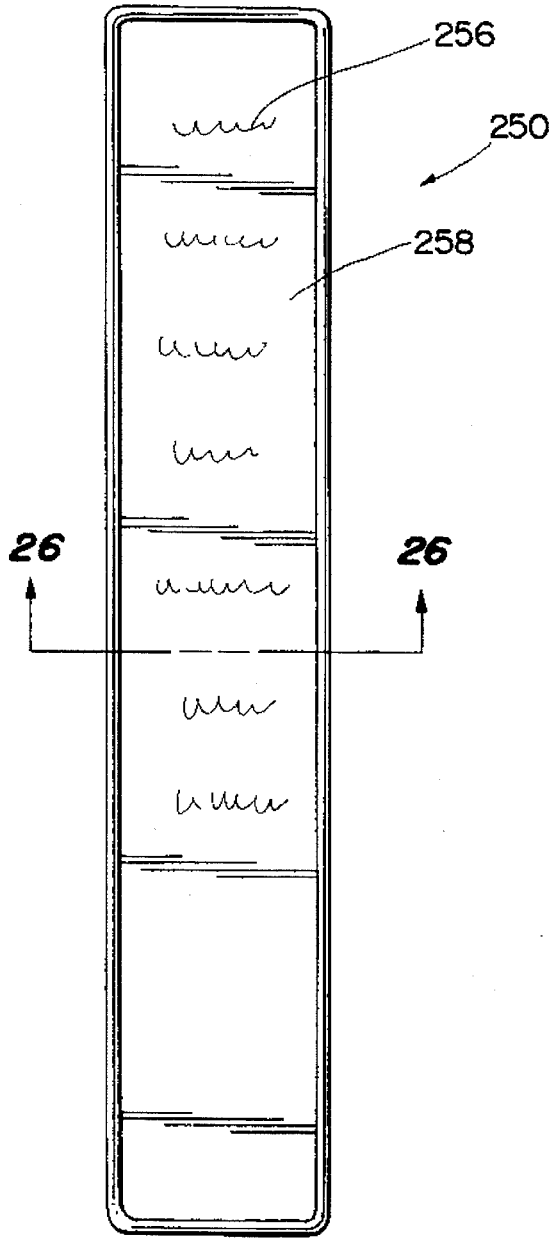
FIG. 25 is a rear view of the bookmark of FIG. 24.
Figure 26:
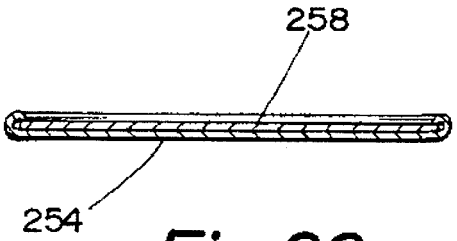
FIG. 26 is a sectional view taken on line 26—26 of FIG. 25.
Figure 27:
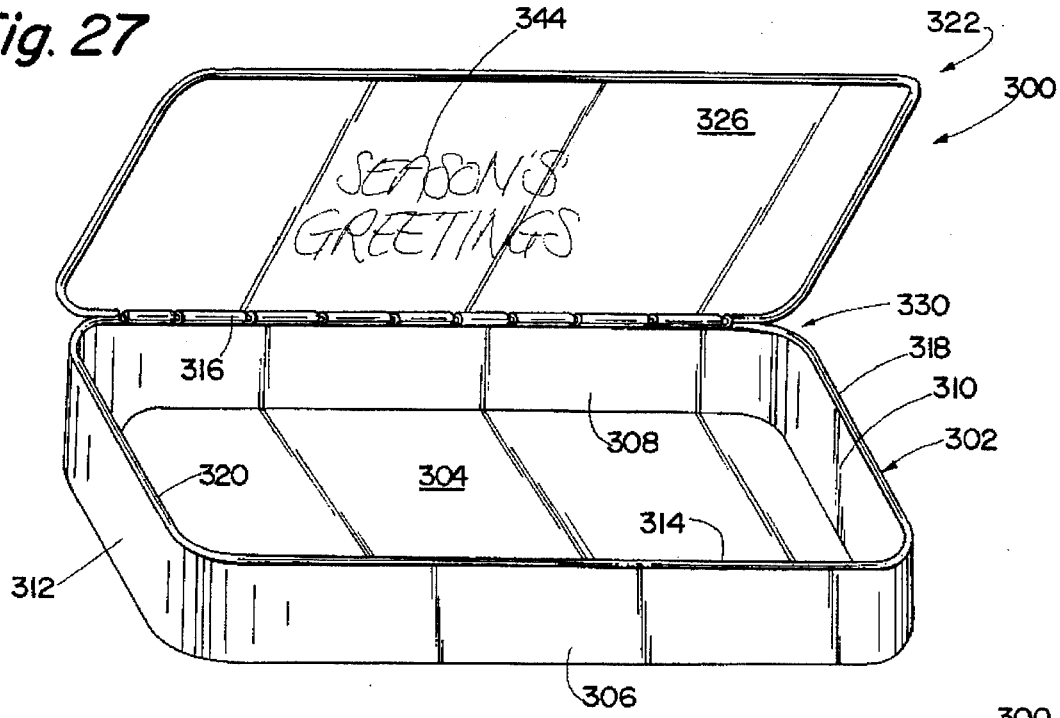
FIG. 27 is a three-dimensional view of a metallic container in the representative form of a gift greeting box in accordance with another embodiment of the invention.
Figure 28:
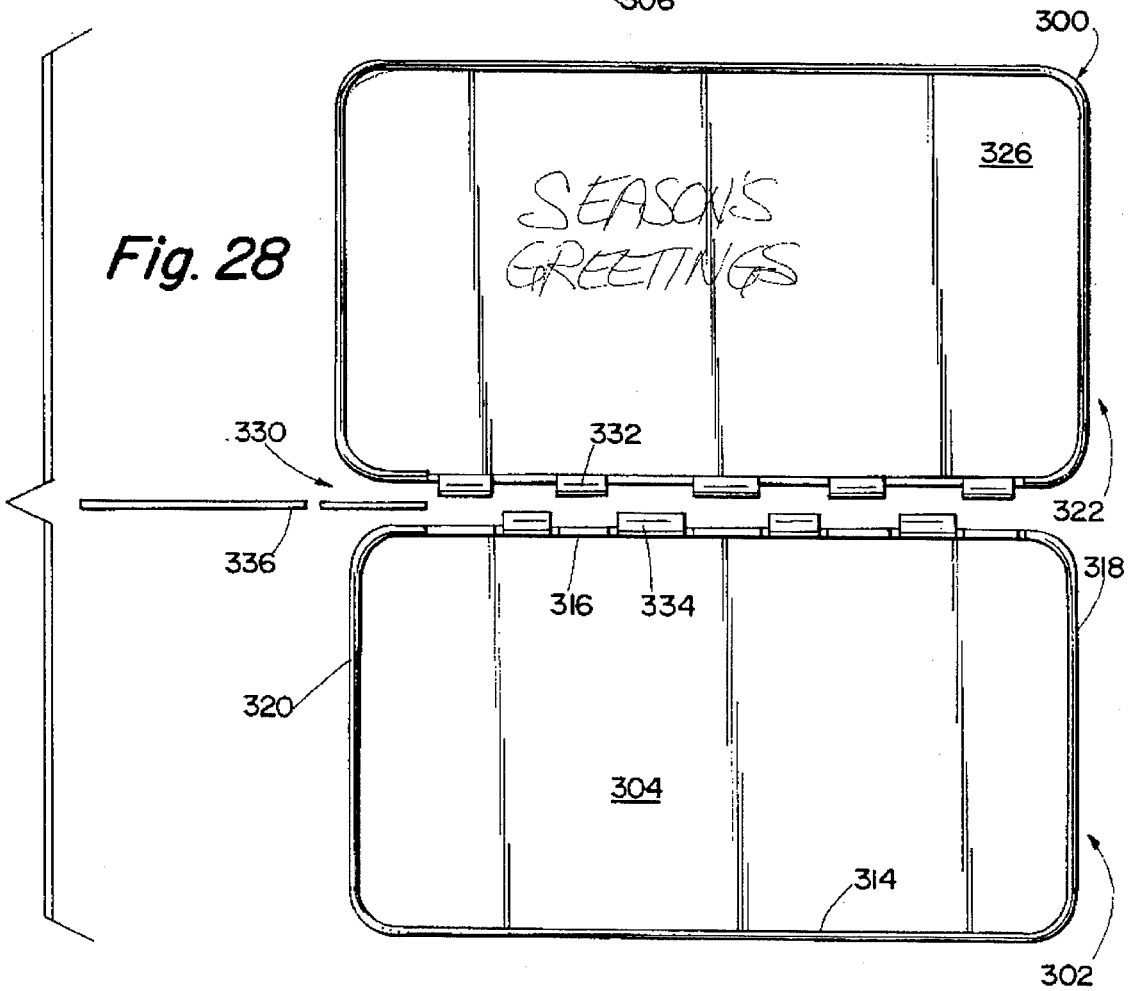
FIG. 28 is an exploded plan view of the gift greeting box of FIG. 27 in its open position.

Referring next to FIGS. 24–26, represented is the manner in which the construction of the dual-medium trading card 10 of FIGS. 1–10 can be extended to any polygonal dual-medium article in general. For purposes of example, the article of FIGS. 24–26 is shown as a bookmark 250, having indicia 252 on the metal front side 254 thereof, and indicia 256 printed on the card stock back 258 thereof. In all other respects, the construction of the bookmark 250 is the same as that of the trading card 10 of FIGS. 1–10, and that description accordingly is not repeated here.

Referring finally to FIGS. 27–34, depicted is yet another embodiment of the invention comprising a container 300, which may comprise a gift greeting box. The container 300 includes a generally rectangular metallic receptacle 302 having a bottom 304 and four upright sides 306, 308, 310 and 312 having respective upper edges 314, 316, 318 and 320. Any suitable article, such as an attractive scene reproduced using three-dimensional techniques (not shown) may be contained within the receptacle 302.

Figure 11:
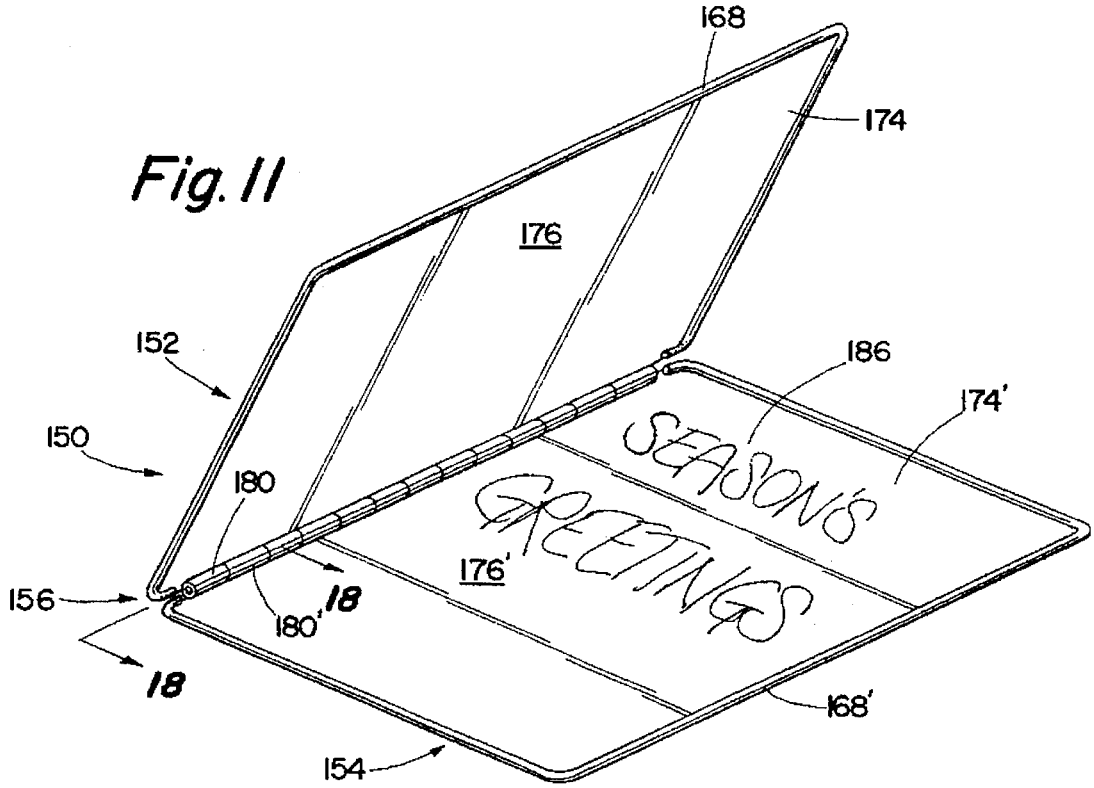
FIG. 11 is a three-dimensional view of a foldable metallic article in the representative form of a greeting card in accordance with another embodiment of the invention.
Figure 34:
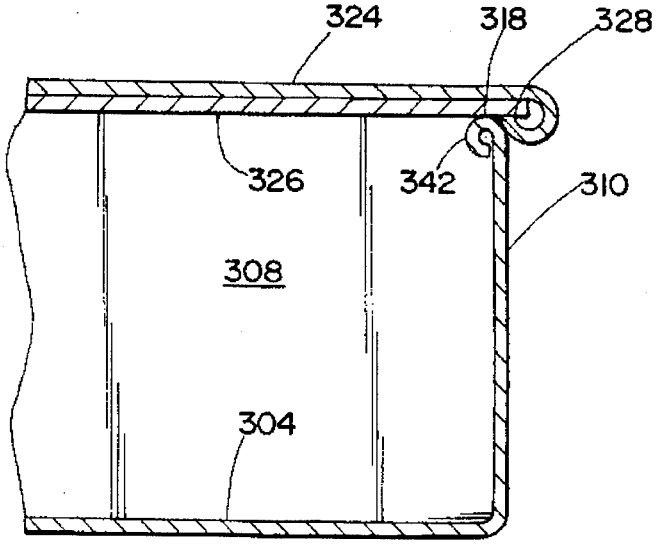
FIG. 34 is a section taken on line 34—34 of FIG. 29.

The container 300 additionally has a generally rectangular cover 322 which is similar to either of the hinged front and back elements 152 and 154 of the greeting card 150 of FIG. 11. The cover 322 thus comprises a generally rectangular metal substrate 324 and an insert sheet 326 retained in position by rolled edges 328 (FIG. 34). The cover 322 is joined to the receptacle 302 by means of a hinge 330, similar in construction to the hinge 156 of FIG. 11.

As best seen in FIGS. 28, 29, 33 and 34, the hinge 330 thus comprises sleeve elements 332 on the cover 322 interdigitated and aligned with sleeve elements 334 on the upper edge 316 of the rear side 308 of the receptacle 302, with a hinge pin 336 positioned within the aligned sleeve elements 334.

Figure 29:
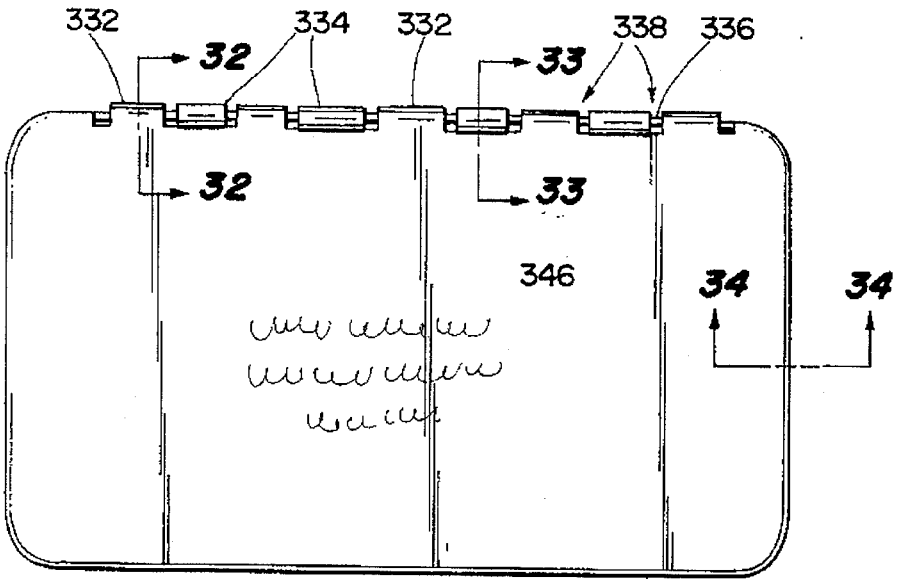
FIG. 29 is a plan view of the gift greeting box of FIG. 27 in its closed position.
Figure 30:
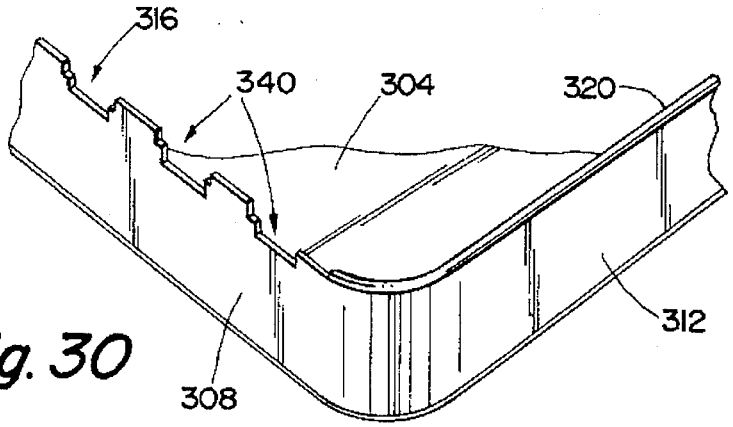
FIG. 30 is a three-dimensional view of the receptacle portion of the gift greeting box of FIG. 27 during an intermediate step in the fabrication process.
Figure 31:
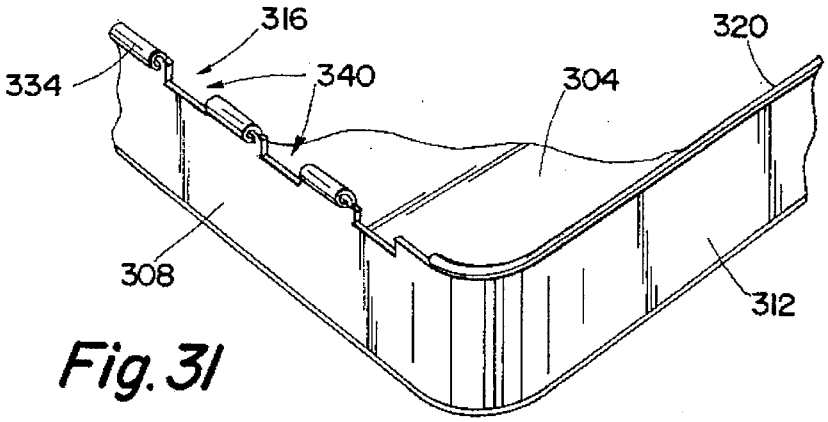
FIG. 31 is a three-dimensional view similar to that of FIG. 30, but with hinge sleeves formed.
Figure 32:
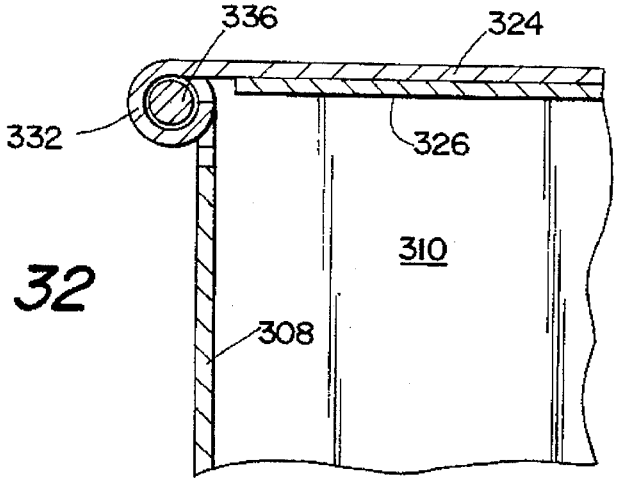
FIG. 32 is a section taken on line 32—32 of FIG. 29.
Figure 33:
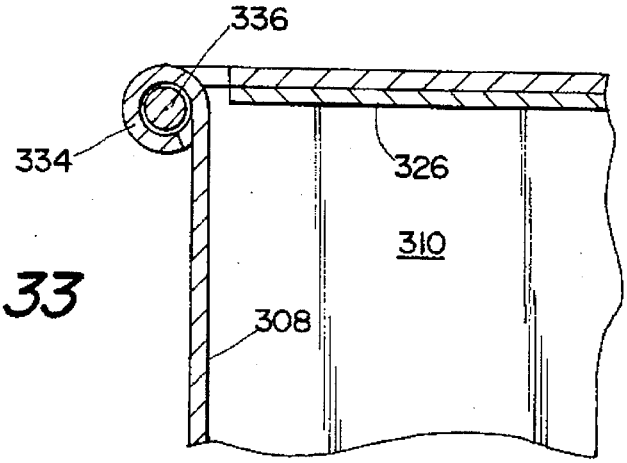
FIG. 33 is a section taken on line 33—33 of FIG. 29.

For proper clearance, and as best seen in FIG. 29, there are gaps 338 between the sleeve elements 332 and 334, and the cover hinge sleeve elements 332 are nested within clearance notches 340 (FIGS. 30 and 31) formed in the receptacle 302 rear side 308. For clarity, FIG. 30 illustrates the structure at an intermediate point during manufacture, prior to forming of the sleeve elements 334.

As seen in FIG. 34, the upper edges 314, 316, 318 and 320 of the receptacle 302 sides 306, 308, 310 and 312 have a protective rolled edge 342.

Finally, appropriate indicia 344 is printed on the bottom side of the insert sheet 326, and a scene or other indicia 346 is printed on the metal top of the cover 322.

While specific embodiments of the invention have been illustrated and described herein, it is realized that numerous modifications and changes will occur to those skilled in the art. It is therefore to be understood that the appended claims are intended to cover all such modifications and changes as fall within the true spirit and scope of the invention.

What is claimed is:

1. A dual-medium article comprising:

a polygonal metal substrate having a front side, a rear side, a main portion, a plurality of edge marginal portions terminating in respective substrate edges, a plurality of corner marginal portions, said edge marginal portions and said corner marginal portions surrounding said main portion and sharing respective boundaries with said main portion, and substrate indicia on said front side;

an insert sheet adjacent said rear side, said insert sheet having an indicia side facing away from said rear side with insert sheet indicia thereon;

said edge marginal portions and said corner marginal portions being rolled towards said rear side such that said substrate edges contact said indicia side of said insert sheet so as to retain said insert sheet in position; and said rolled edge marginal portions and said rolled corner marginal portions together defining a continuous bead around the periphery of said article without any exposed sharp edges.

2. A dual-medium article in accordance with claim 1, comprising a rectangular metal substrate having four edge marginal portions and four corner marginal portions.

3. A dual-medium article in accordance with claim 1, which comprises a bookmark.

4. A dual-medium article in accordance with claim 1, which is formed from a flat blank wherein said corner marginal portions have concave cutouts to avoid interference when said side marginal portions are rolled.

5. A dual-medium article in accordance with claim 4, wherein each of said corner marginal portions has material remaining between the respective concave cutout and the boundary shared by the corner marginal portion and said main portion.

6. A dual-medium article in accordance with claim 1, wherein said substrate main portion has embossed areas.

7. A dual-medium article in accordance with claim 1, wherein said insert sheet comprises a paper-based material.

8. A foldable dual-medium article comprising a pair of polygonal article elements joined by a hinge, each of said article elements comprising:

a polygonal metal substrate having an outer side, an inner side, a main portion, a plurality of edge marginal portions terminating in respective substrate edges, and a plurality of corner marginal portions, said edge marginal portions and said corner marginal portions surrounding said main portion and sharing respective boundaries with said main portion, an insert sheet adjacent said inner side, said insert sheet having a side facing away from said inner side, at least a portion of one of said edge marginal portions including an element of said hinge, the others of said edge marginal portions and said corner marginal portions being rolled towards said inner side such that said substrate edges terminating the others of said edge margin portions contact said side of said insert sheet facing away from said inner side so as to retain said insert sheet in position, and said rolled edge marginal portions and said rolled corner marginal portions together defining a continuous bead without any exposed sharp edges.

9. A dual-medium article in accordance with claim 8, comprising a pair of rectangular-article elements, each having four edge marginal portions and four corner marginal portions.

10. A foldable dual-medium article in accordance with claim 8, wherein at least one of said metal substrates has substrate indicia on the outer side thereof, and at least one of said insert sheets has insert sheet indicia on said side facing away from said inner side.

11. A foldable dual-medium article in accordance with claim 10, which comprises a greeting card.

12. A foldable dual-medium article in accordance with claim 8, wherein:

the elements of said hinge included on each of said article elements comprise sleeve elements formed in said at least a portion of one of said edge marginal portions;

sleeve elements of one of said article elements are interdigitated and aligned with sleeve elements of the other of said article elements; and said hinge comprises a hinge pin positioned within the aligned sleeve elements.

13. A foldable dual-medium article in accordance with claim 8, which comprises a greeting card.

14. A foldable dual-medium article in accordance with claim 8, wherein said insert sheets comprise a paper-based material.

15. A foldable dual-medium article in accordance with claim 8, wherein the metal substrate of each of said article elements is formed from a flat blank wherein said corner marginal portions have concave cutouts to avoid interference when said side marginal portions are rolled.

16. A foldable dual-medium article in accordance with claim 15, wherein each of said corner marginal portions has material remaining between the respective concave cutout and the boundary shared by the corner marginal portion and said main portion.

17. A dual-medium stand-up indicia-bearing article comprising:

a polygonal metal substrate having a front side, a rear side, a main portion, a plurality of edge marginal portions terminating in respective substrate edges, a plurality of corner marginal portions, said edge marginal portions and said corner marginal portions surrounding said main portion and sharing respective boundaries with said main portion, and substrate indicia on said front side;

an insert sheet adjacent said rear side, said insert sheet having a visible side facing away from said rear side;

said insert sheet having cut lines defining a fold-out easel;

said edge marginal portions and said corner marginal portions being rolled towards said rear idle such that said substrate edges contact said visible side of said insert sheet so as to retain said insert sheet in position; and said rolled edge marginal portions and said rolled corner marginal portions together defining a continuous bead around the periphery of said article without any exposed sharp edges.

18. A dual-medium stand-up indicia-bearing article in accordance with claim 17, comprising a rectangular substrate having four edge marginal portions and four corner marginal portions.

19. A dual-medium stand-up indicia article in accordance with claim 17, which comprises a calendar and wherein said substrate indicia comprise-calendar indicia.

20. A dual-medium article in accordance with claim 17, which is formed from a flat blank wherein said corner marginal portions have concave cutouts to avoid interference when said side marginal portions are rolled.

21. A dual-medium article in accordance with claim 20, wherein each of said corner marginal portions has material remaining between the respective concave cutout and the boundary shared by the corner marginal portion and said main portion.

22. A dual-medium article in accordance with claim 17, wherein said insert sheet comprises a paper-based material.

23. A container comprising:

a generally rectangular metal receptacle having a bottom and four upright sides having respective upper edges;

a generally rectangular dual-medium cover having one edge joined by a hinge to the upper edge of one of said upright sides, said cover comprising:

a generally rectangular metal substrate having a top side, a bottom side, a main portion, four edge marginal portions terminating in respective substrate edges, four corner marginal portions, said edge marginal portions and said corner marginal portions surrounding said main portion and sharing respective boundaries with said main portion, and substrate indicia on said top side, an insert sheet adjacent said bottom side, said insert sheet having an indicia side facing away from said bottom side with insert sheet indicia thereon, at least a portion of one of said edge marginal portions including an element of said hinge, the others of said edge marginal portions and said corner marginal portions being rolled towards said bottom side such that said substrate edges terminating the others of said edge marginal portions contact said indicia side of said insert sheet so as to retain said insert sheet in position, said rolled edge marginal portions and said rolled corner marginal portions together defining a continuous bead without any exposed sharp edges; and another element of said hinge being included in at least a portion of said upper edge of said one of said upright sides of said receptacle.

24. A container in accordance with claim 23, wherein:

the element of said hinge included on said cover comprises sleeve elements formed in said at least a portion of one of said edge marginal portions;

said another element of said hinge included on said receptacle comprises sleeve elements formed in said at least a portion of said upper edge;

sleeve elements of said cover are interdigitated and aligned with sleeve elements of said receptacle; and said hinge comprises a hinge pin positioned within the aligned sleeve elements.

25. A container in accordance with claim 23, which comprises a gift greeting box.

26. A container in accordance with claim 23, wherein said cover is formed from a flat blank wherein said corner marginal portions have concave cutouts to avoid interference when said side marginal portions are rolled.

27. A container in accordance with claim 26, wherein each of said corner marginal portions of said cover has material remaining between the respective concave cutout and the boundary shared by the corner marginal portion and said main portion.

28. A container in accordance with claim 23, wherein said insert sheet comprises a paper-based material.

* * * * *